US005484057A

United States Patent [19]

Tzu-Ching

[11] Patent Number: 5,484,057

[45] Date of Patent: Jan. 16, 1996

[54] TOOL PACKAGING CONTAINER

[76] Inventor: Lin Tzu-Ching, P.O. Box 82-144, Taipei, Taiwan

[21] Appl. No.: 276,425

[22] Filed: Jul. 18, 1994

[51] Int. Cl.[6] ..... B65D 85/20; B65D 21/024

[52] U.S. Cl. ..... 206/374; 206/378; 220/23.4; 220/23.6; 220/4.26; 220/4.27; 220/4.03

[58] Field of Search ..... 206/372, 373, 206/374, 375, 378, 379, 234; 220/23.4, 23.6, 4.26, 4.27, 326, 4.03

[56] References Cited

U.S. PATENT DOCUMENTS

| | | | |
|---|---|---|---|
| 3,773,213 | 11/1973 | Frederick | 206/509 X |
| 4,151,912 | 5/1979 | Harrold | 206/372 X |
| 4,619,363 | 10/1986 | Wolfseder | 206/372 X |
| 4,889,254 | 12/1989 | Vola | 220/23.4 |
| 5,004,106 | 4/1991 | Blumstock et al. | 220/524 X |
| 5,050,755 | 9/1991 | Strawder | 220/23.4 |
| 5,083,664 | 1/1992 | Feng | 206/376 X |
| 5,133,455 | 7/1992 | Chow | 206/373 X |

FOREIGN PATENT DOCUMENTS

| | | | |
|---|---|---|---|
| 1327262 | 4/1963 | France | 220/4.26 |
| 3306348 | 8/1984 | Germany | 220/23.4 |
| 2204566 | 11/1988 | United Kingdom | 220/23.4 |

*Primary Examiner*—Paul T. Sewell
*Assistant Examiner*—Ted Kavanaugh
*Attorney, Agent, or Firm*—Alfred Lei

[57] ABSTRACT

A tool packaging container including a rectangular body portion having a recess at a central portion, a flange at a bottom, and a plurality of vertical dovetail grooves at both sides, and two rectangular extension containers connected with both sides of the rectangular body portion. Each of the rectangular extension containers is one-half as long as the rectangular body portion and provided at one side with a plurality of dovetails and at another side with a plurality of dovetail retainers. The dovetails of the rectangular extension containers are adapted to engage the dovetail grooves of the rectangular body portion and are adapted to engage the dovetail retainers of another one of the rectangular extension containers. Each of the rectangular extension containers is formed with a neck at an upper portion, a pair of lugs at one end. A shoulder at another end, and a closable cover has a curved portion at one end adapted to engage the shoulder of the rectangular extension container and a clamping portion at another end adapted to engage the lugs of the rectangular extension containers.

1 Claim, 8 Drawing Sheets

TOOL PACKAGING CONTAINER

BACKGROUND OF THE INVENTION

It has been found that the conventional tool packaging container 1 (see FIG. 1) is an elongated member with a plurality of recesses 2 for receiving tools 100. However, such a tool packaging container 1 cannot keep the tools from exposing to the air thereby making the tools rust easily. Hence, an improved tool packaging container 20 (see FIG. 2) with a top cover 21 and a bottom cover 22 has been developed to obviate this drawback. However, such an improved tool packaging container 20 is too large in volume thereby making it inconvenient to carry.

Therefore, it is an object of the present invention to provide a tool packaging container which can obviate and mitigate the above-mentioned drawbacks.

SUMMARY OF THE INVENTION

This invention relates to an improved tool packaging container.

It is the primary object of the present invention to provide a tool packaging container which can be conveniently enlarged as desired.

It is another object of the present invention to provide a tool packaging container which is simple in construction.

It is still another object of the present invention to provide a tool packaging container which is compact in size.

It is still another object of the present invention to provide a tool packaging container which is economic for transportation.

It is a further object of the present invention to provide a tool packaging container which is low in cost.

These and other objects and advantages of the present invention will become clear to those skilled in the art in view of the description of the best presently known mode of carrying out the invention and the industrial applicability of the preferred embodiment, as described herein and as illustrated in the several figures of the drawing.

DETAILED DESCRIPTION OF THE PREFERRED EMBODIMENT

Figure 1:
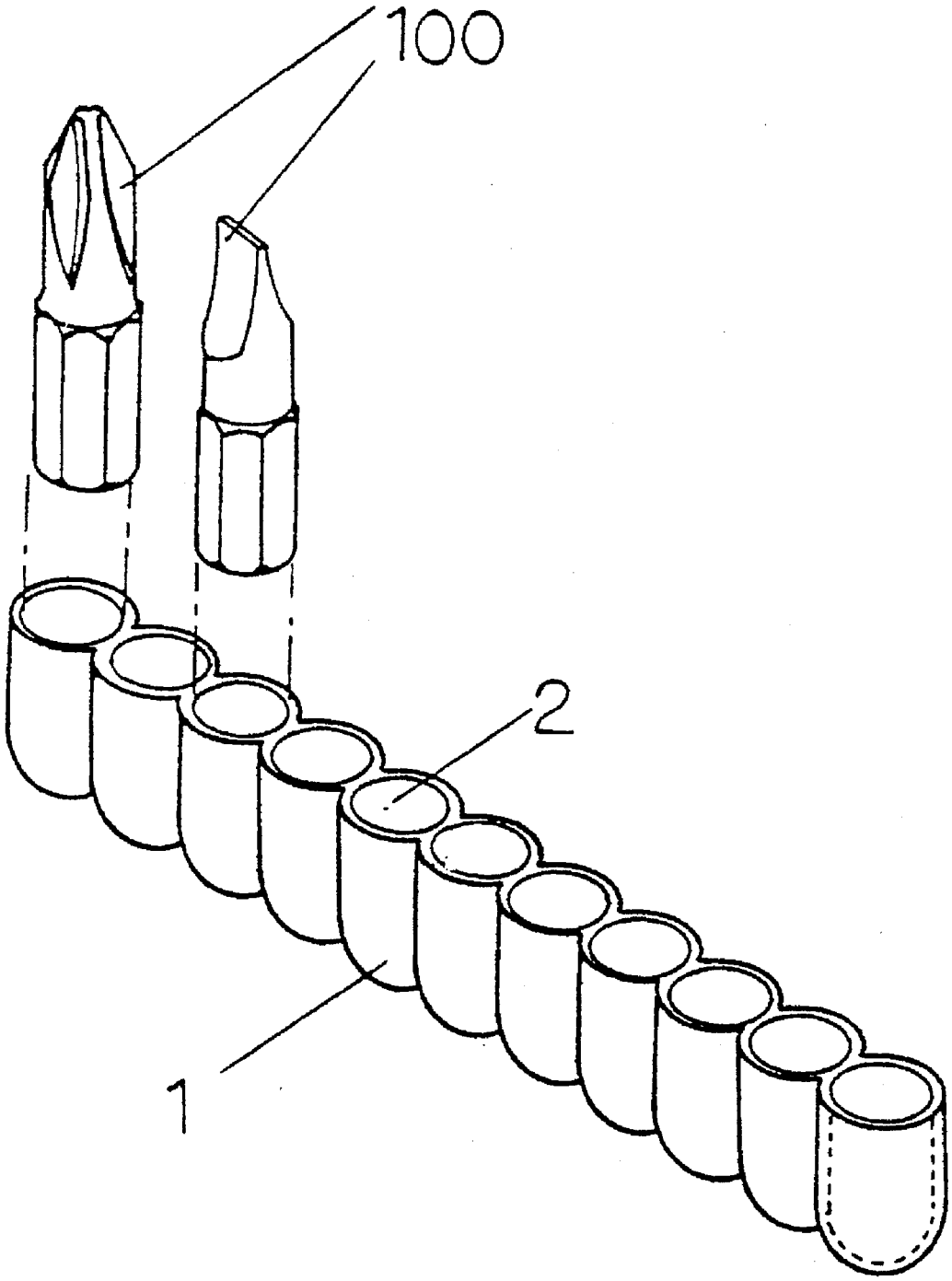
PRIOR ART FIG. 1
FIG. 1 is a perspective view of a prior art tool packaging container.
Figure 2:
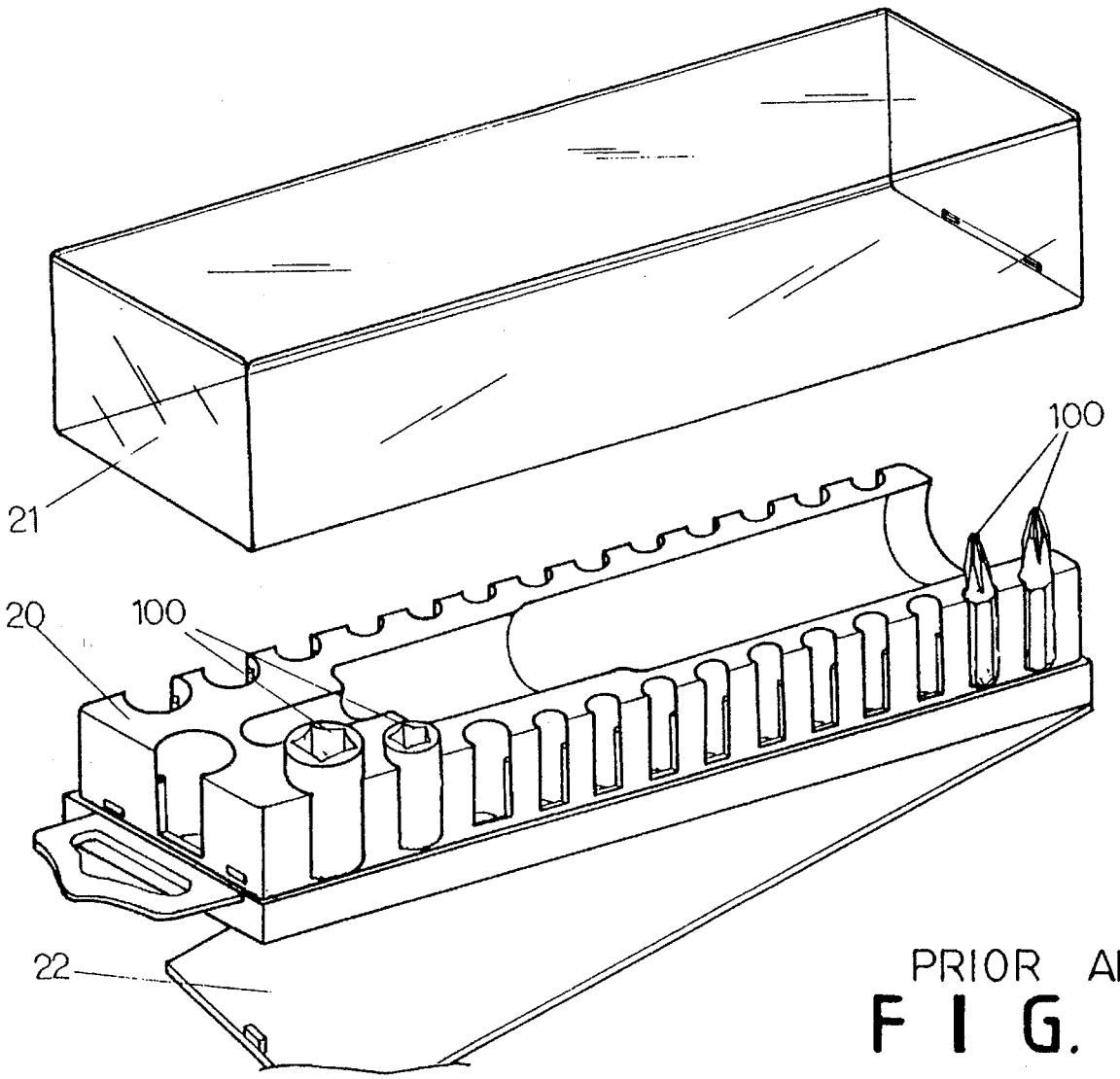
PRIOR ART FIG. 2
FIG. 2 is a perspective view of another prior art tool packaging container.

For purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 3:
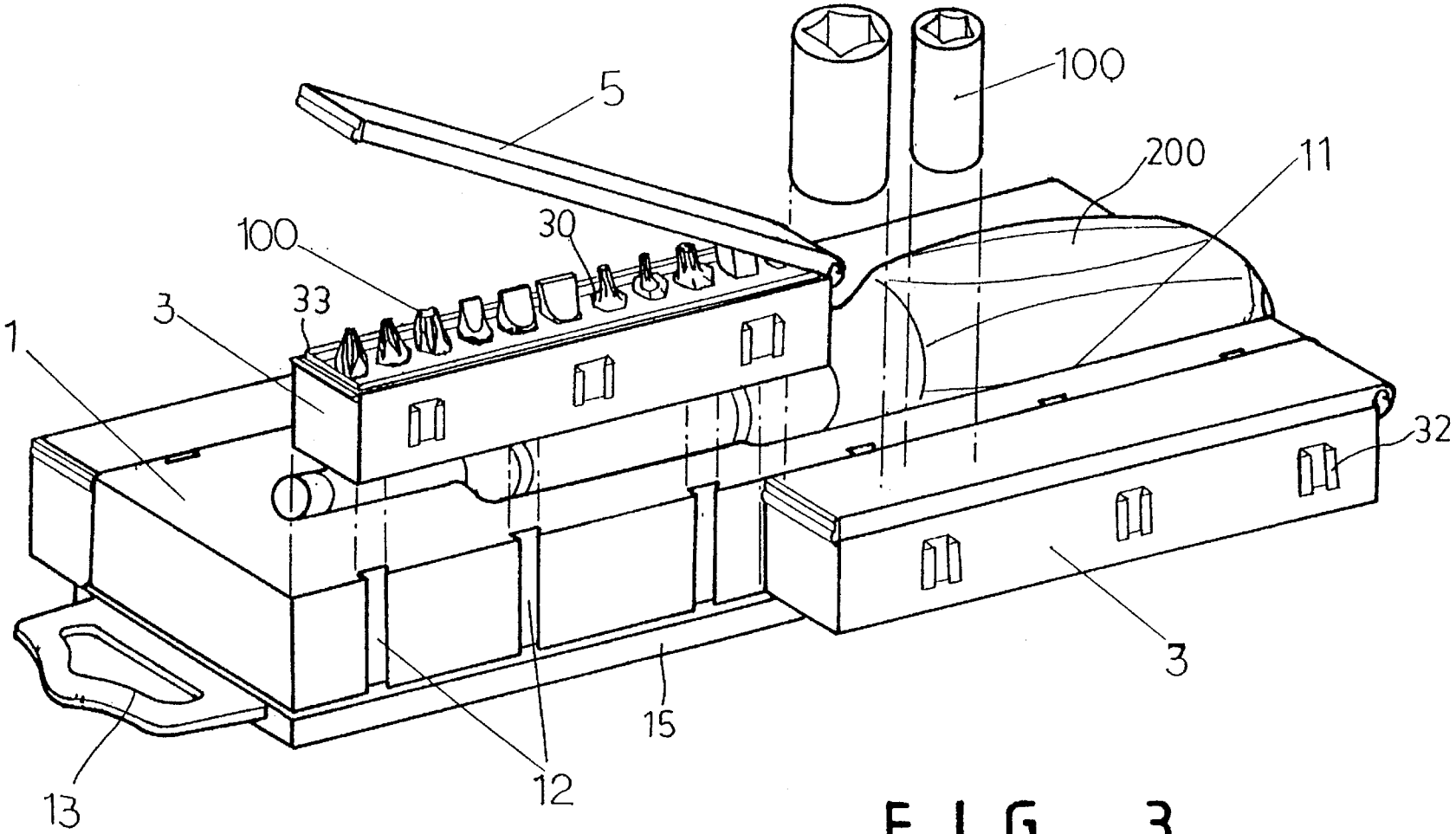
FIG. 3 is a perspective view of a tool packaging container according to the present invention.

With reference to the drawings and in particular to FIG. 3 thereof, the tool case according to the present invention mainly comprises a rectangular body portion 1 and a plurality of rectangular extension containers 3.

Figure 4:
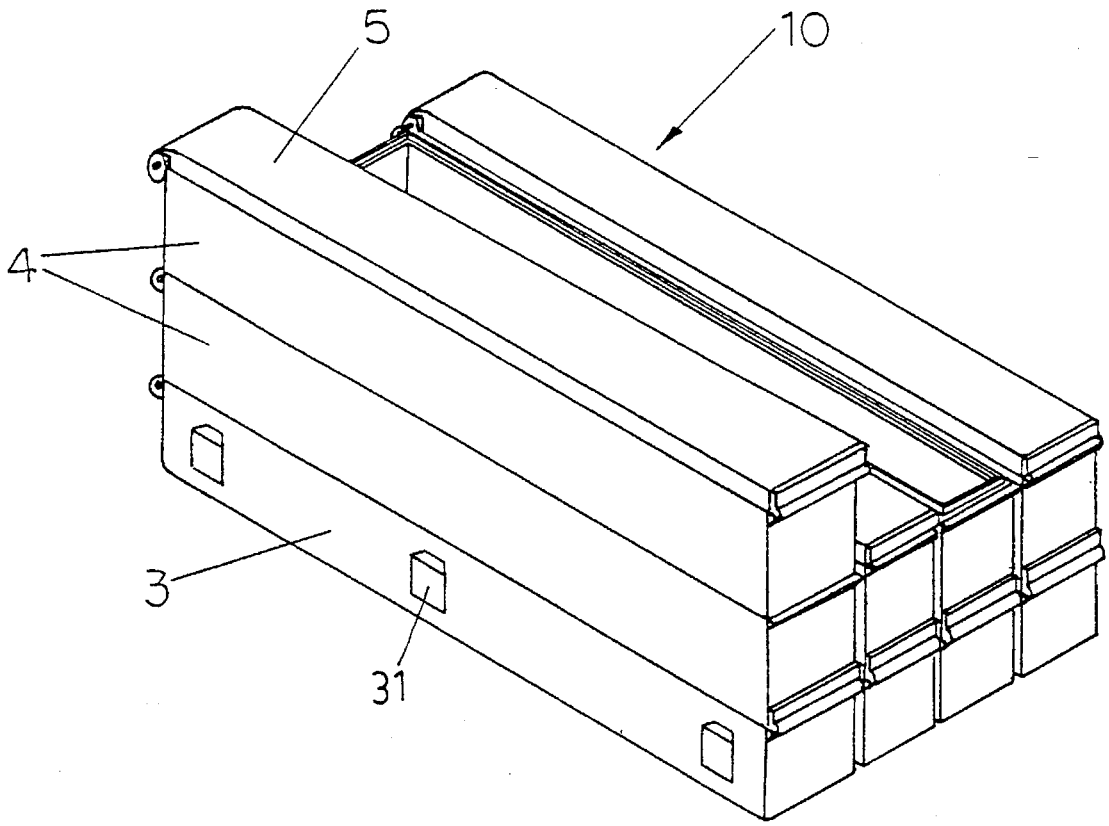
FIG. 4 shows the connection between the extension container and the additional container.
Figure 5:
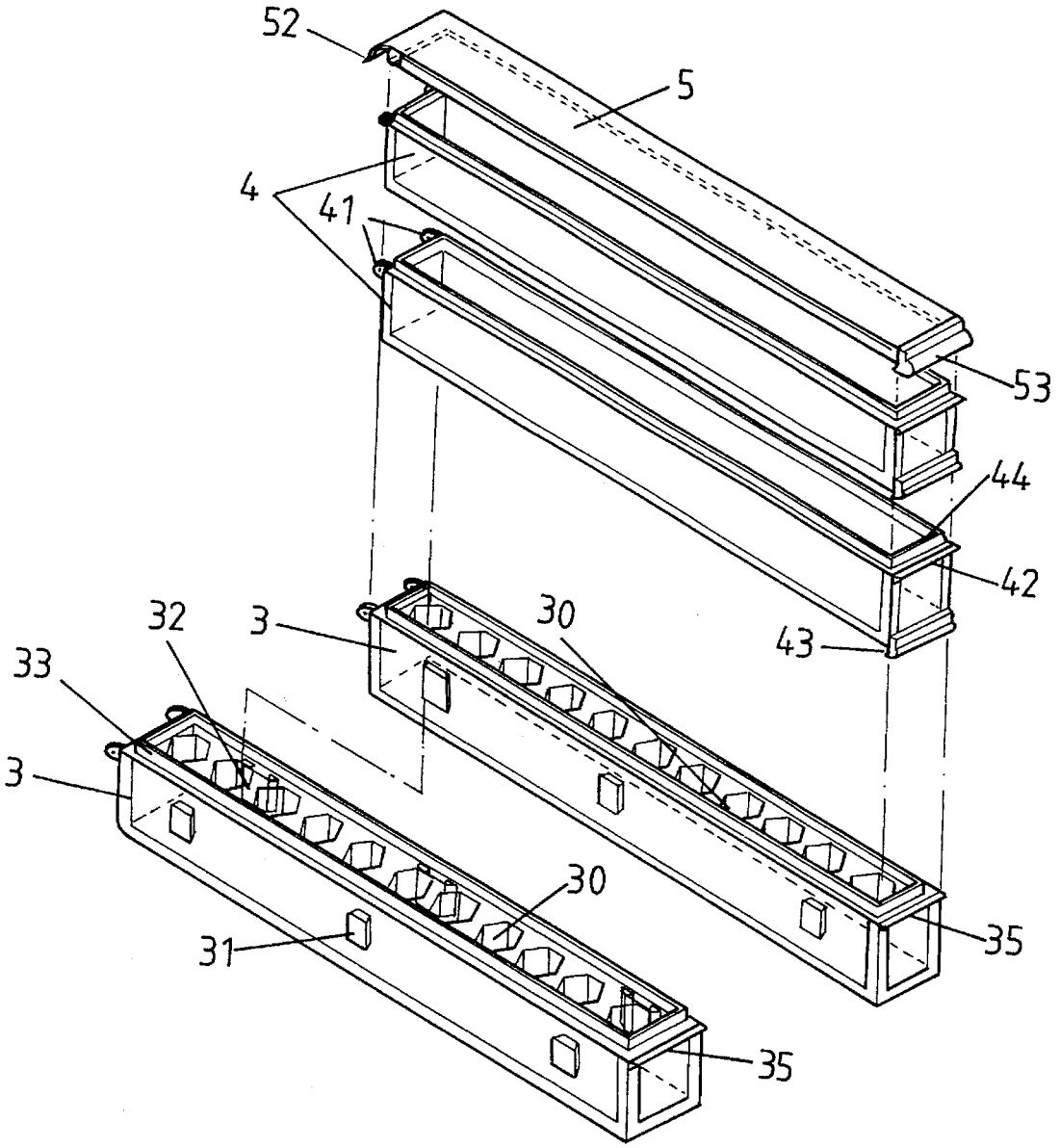
FIG. 5 is a perspective view illustrating the way to connect the extension container, the additional container and the closable cover.
Figure 6:
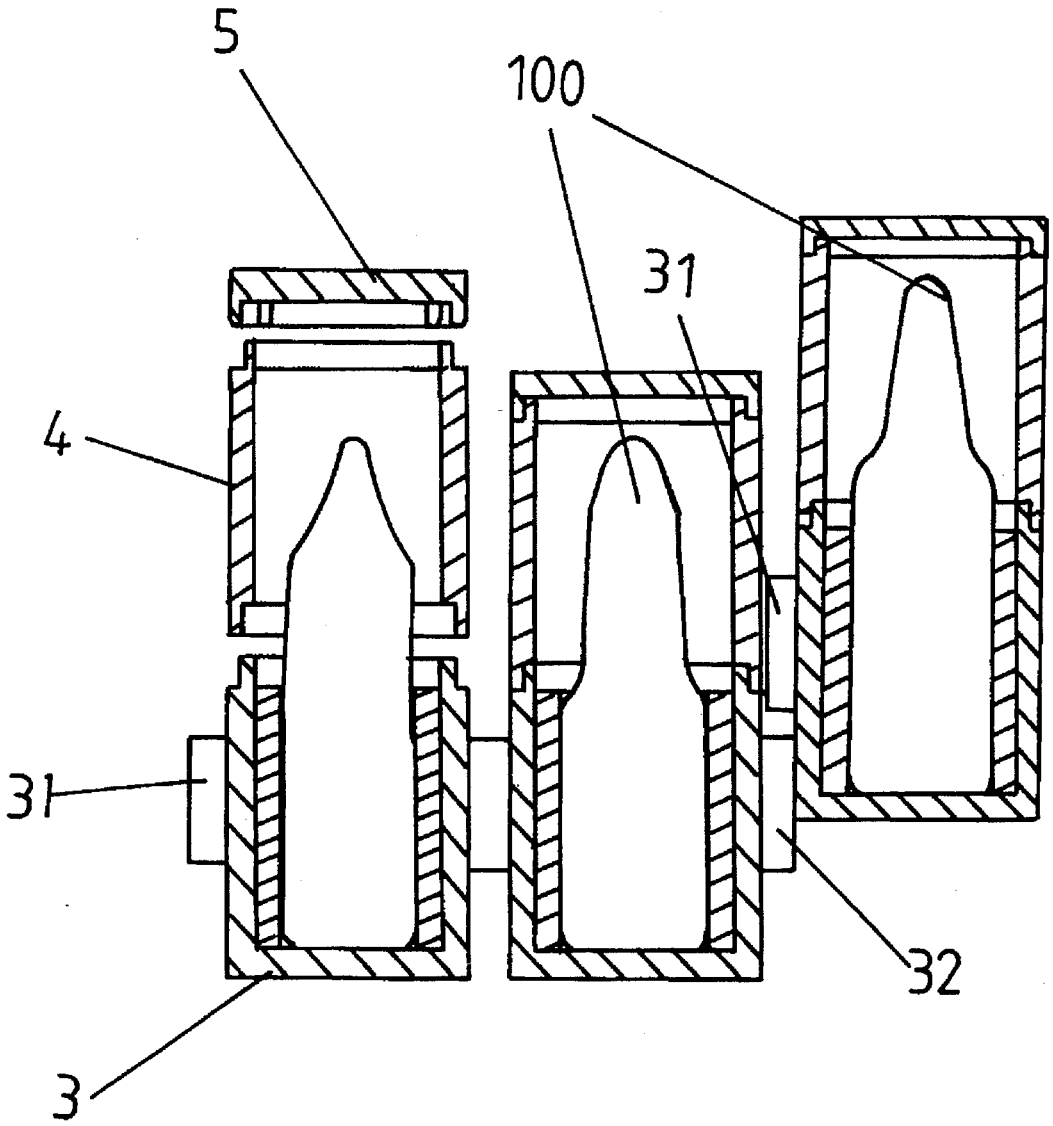
FIG. 6 is a sectional view showing the connection between the extension container and the additional container.
Figure 7:
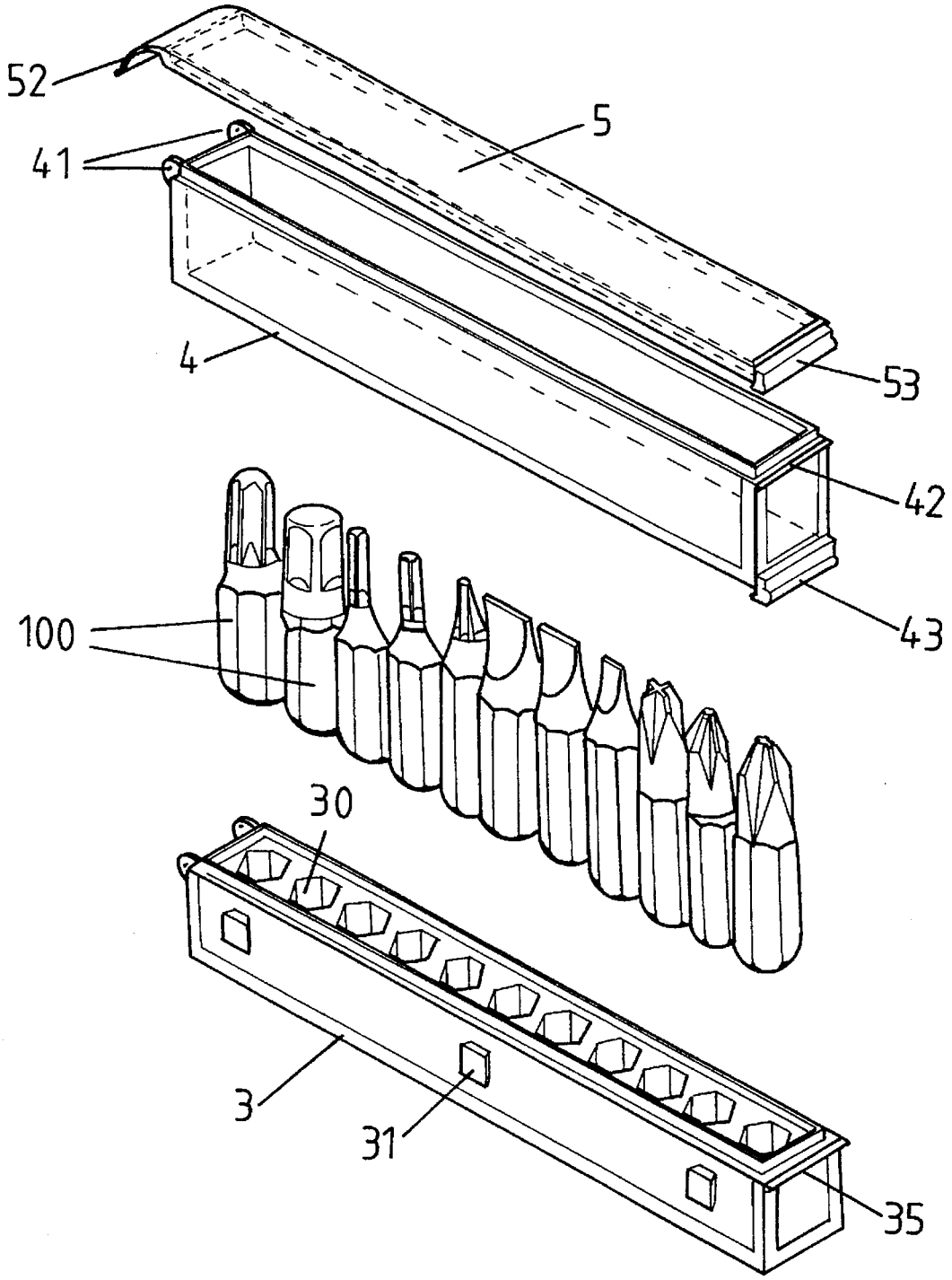
FIG. 7 shows the way to fit the tools into the combined additional container and extension container.
Figure 8:
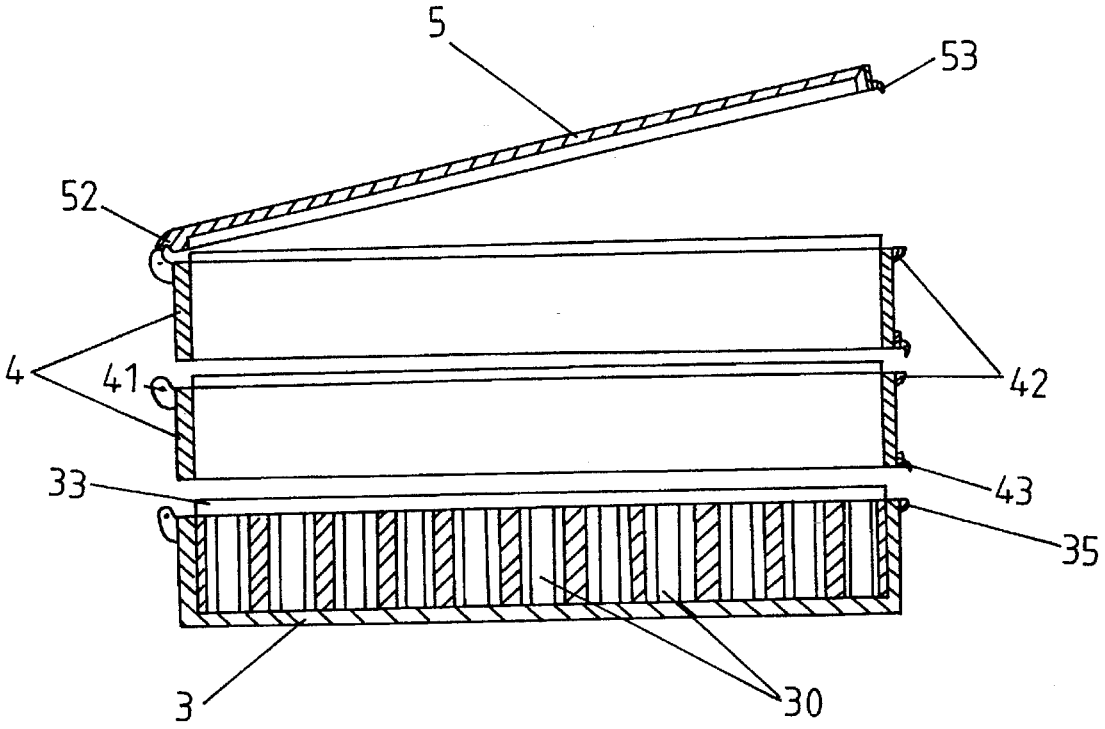
FIG. 8 is another sectional view showing the connection between the extension container and the additional container.

As illustrated, the rectangular body portion i is formed with a recess 11 at the central for receiving a tool 200, a flange 15 at the bottom of the rectangular body portion 1, a plurality of vertical dovetail grooves 12 at both sides, and a hook member 13 at the left end. The rectangular extension container 3 is one-half as long as the rectangular body portion 1 and provided at one side with a plurality of dovetails 31 (see FIG. 4) adapted to engage with the dovetail grooves 12 of the rectangular body portion 1 so that the extension container 3 can be connected with the rectangular body portion 1 without dropping down therefrom. Further, the other side of the extension container 3 is provided with a plurality of dovetail retainers 32 adapted to firmly engage the dovetails 31 of another extension container 3. The extension container 3 is formed with a plurality of cavities 30 for receiving tool bits 100. In addition, the extension container 3 has a neck 33 at the upper portion and a closable cover 5. The closable cover 5 is provided with a clamping portion 52 at one end and a curved portion 53 at another end.

Referring to FIGS. 4, 5, 6, 7 and 8, a plurality of extension containers 3 are connected together to form a larger container. On each of the extension container 3 is fitted a rectangular additional container 4 which is open at the top and the bottom. Further, the additional container 4 has a curved portion 43 at a lower corner adapted to engage the shoulder 35 of the rectangular, extension container 3, a neck 44 at an upper portion adapted to engage the bottom of another rectangular additional container 4, a shoulder 42 at one upper edge adapted to engage the curved portion 53 of the closable cover 5, and a pair of lugs 41 at another upper edge adapted to engage the clamping portion 52 of the closable cover 5.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

I claim:

1. A tool packaging container comprising:

a rectangular body portion having a recess at a central portion, a flange at a bottom, and a plurality of vertical dovetail grooves at both sides; and two rectangular extension containers connected with both sides of said rectangular body portion, each of said rectangular extension containers being one-half as long as said rectangular body portion and provided at one side with a plurality of dovetails and at another side with a plurality of dovetail retainers, the dovetails of one of said rectangular extension containers being adapted to engage the dovetail grooves of said rectangular body portion and being adapted to engage the dovetail retainers of another one of said rectangular extension containers, each of said rectangular extension containers being formed with a raised edge at an upper portion, two lugs at one end, and a shoulder at another end;

a closable cover having a curved portion at one end adapted to engage the shoulder of said rectangular extension container and a clamping portion at another end adapted to engage the lugs of said rectangular extension containers; and a rectangular additional container which is open at a top and at a bottom, said rectangular additional container being engaged with a neck of one of said rectangular extension containers and formed with a curved portion at a lower corner adapted to engage the shoulder of each of said rectangular extension containers, a neck at an upper portion adapted to engage a bottom of another rectangular additional container, a shoulder at an upper edge adapted to engage the curved portion of said closable cover, and a pair of lugs at another upper edge adapted to engage the clamping portion of said closable cover.

* * * * *